US008118669B2

(12) United States Patent
Rader et al.

(10) Patent No.: US 8,118,669 B2
(45) Date of Patent: Feb. 21, 2012

(54) SYSTEM AND METHOD FOR PROVIDING POKER PLAYER TRACKING AND BONUS EVENTS

(75) Inventors: Richard M. Rader, Albany, OR (US); Eric W. Lancaster, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 12/352,962

(22) Filed: Jan. 13, 2009

(65) Prior Publication Data

US 2009/0124319 A1 May 14, 2009

Related U.S. Application Data

(62) Division of application No. 11/215,474, filed on Aug. 30, 2005, now abandoned.

(51) Int. Cl.
*A63F 9/00* (2006.01)

(52) U.S. Cl. ..... 463/27; 463/13

(58) Field of Classification Search ..... 463/13, 463/27

See application file for complete search history.

(56) References Cited

U.S. PATENT DOCUMENTS

| | | | |
|---|---|---|---|
| 2,743,108 | A | 4/1956 | Sanders |
| 3,904,207 | A | 9/1975 | Gold |
| 4,363,485 | A | 12/1982 | Edwall |
| 4,582,324 | A | 4/1986 | Koza et al. |
| 4,618,150 | A | 10/1986 | Kimura |
| 4,652,998 | A | 3/1987 | Koza et al. |
| 4,659,087 | A | 4/1987 | Shen et al. |
| 4,695,053 | A | 9/1987 | Vazquez, Jr. et al. |
| 4,743,022 | A | 5/1988 | Wood |
| 4,775,155 | A | 10/1988 | Lees |
| 4,807,884 | A | 2/1989 | Breeding |
| 4,836,553 | A | 6/1989 | Suttle et al. |
| 4,844,464 | A | 7/1989 | Berge |
| 4,861,041 | A | 8/1989 | Jones et al. |
| 5,019,973 | A | 5/1991 | Wilcox et al. |
| 5,033,744 | A | 7/1991 | Bridgeman et al. |
| 5,087,405 | A | 2/1992 | Maker |
| 5,098,107 | A | 3/1992 | Boylan et al. |
| 5,116,055 | A | 5/1992 | Tracy |
| 5,154,429 | A | 10/1992 | LeVasseur |
| 5,174,579 | A | 12/1992 | Griffiths |

(Continued)

FOREIGN PATENT DOCUMENTS

EP 0 449 433 10/1991

(Continued)

OTHER PUBLICATIONS

Advantage Casino System Bonusing Brochure, written by IGT, available prior to Aug. 30, 2005.

(Continued)

*Primary Examiner* — Dmitry Suhol
*Assistant Examiner* — David Duffy
(74) *Attorney, Agent, or Firm* — K&L Gates LLP

(57) ABSTRACT

A gaming system having a gaming table and including a progressive jackpot funded by a portion of the house rake of a card game played at the gaming table. The gaming system includes a tracking system capable of identifying and tracking cards dealt and wagers placed in order to identify frequent players and provide complimentary items accordingly. The gaming system is also capable of notifying a player at a remote gaming device that a seat at the gaming table is open.

16 Claims, 8 Drawing Sheets

U.S. PATENT DOCUMENTS

| | | | |
|---|---|---|---|
| 5,205,555 | A | 4/1993 | Hamano |
| 5,248,142 | A | 9/1993 | Breeding |
| 5,275,400 | A | 1/1994 | Weingardt et al. |
| 5,275,416 | A | 1/1994 | Schorr et al. |
| 5,280,909 | A | 1/1994 | Tracy |
| 5,288,077 | A | 2/1994 | Jones |
| 5,288,081 | A | 2/1994 | Breeding |
| 5,292,127 | A | 3/1994 | Kelly et al. |
| 5,334,836 | A | 8/1994 | Filo |
| 5,342,047 | A | 8/1994 | Heidel et al. |
| 5,342,049 | A | 8/1994 | Wichinsky et al. |
| 5,344,144 | A | 9/1994 | Canon |
| 5,362,053 | A | 11/1994 | Miller |
| 5,364,105 | A | 11/1994 | Jones |
| 5,377,973 | A | 1/1995 | Jones et al. |
| 5,377,993 | A | 1/1995 | Josephs |
| 5,390,934 | A | 2/1995 | Grassa |
| 5,393,057 | A | 2/1995 | Marnell, II |
| 5,393,067 | A | 2/1995 | Paulsen et al. |
| 5,407,200 | A | 4/1995 | Zalabah |
| 5,411,271 | A | 5/1995 | Mirando |
| 5,417,430 | A | 5/1995 | Breeding |
| 5,431,407 | A | 7/1995 | Hofberg et al. |
| 5,452,899 | A | 9/1995 | Skratulia et al. |
| 5,454,570 | A | 10/1995 | Karal |
| 5,476,259 | A | 12/1995 | Weingardt |
| 5,489,101 | A | 2/1996 | Moody |
| 5,494,296 | A | 2/1996 | Grassa |
| 5,529,309 | A | 6/1996 | Bartlett |
| 5,531,440 | A | 7/1996 | Dabrowski et al. |
| 5,536,016 | A | 7/1996 | Thompson |
| 5,542,669 | A | 8/1996 | Charron et al. |
| 5,560,603 | A | 10/1996 | Seelig et al. |
| 5,564,700 | A | 10/1996 | Celona |
| 5,570,885 | A | 11/1996 | Ornstein |
| 5,577,731 | A | 11/1996 | Jones |
| 5,584,485 | A | 12/1996 | Jones et al. |
| 5,584,763 | A | 12/1996 | Kelly et al. |
| 5,597,162 | A | 1/1997 | Franklin |
| 5,611,730 | A | 3/1997 | Weiss |
| 5,615,888 | A | 4/1997 | Lofink et al. |
| 5,626,341 | A | 5/1997 | Jones et al. |
| 5,632,485 | A | 5/1997 | Woodland et al. |
| 5,639,088 | A | 6/1997 | Schneider et al. |
| 5,639,089 | A | 6/1997 | Matsumoto et al. |
| 5,641,730 | A | 6/1997 | Brown |
| 5,645,486 | A | 7/1997 | Nagao et al. |
| 5,649,705 | A | 7/1997 | String |
| 5,651,548 | A | 7/1997 | French et al. |
| 5,660,391 | A | 8/1997 | Klasee |
| 5,660,393 | A | 8/1997 | Dreger |
| 5,664,781 | A | 9/1997 | Feola |
| 5,673,917 | A | 10/1997 | Vancura |
| 5,678,821 | A | 10/1997 | Hedman |
| 5,685,774 | A | 11/1997 | Webb |
| 5,707,287 | A | 1/1998 | McCrea, Jr. |
| 5,718,430 | A | 2/1998 | Aramapakul et al. |
| 5,720,483 | A | 2/1998 | Trinh |
| 5,735,742 | A | 4/1998 | French |
| 5,743,523 | A | 4/1998 | Kelly et al. |
| 5,755,619 | A | 5/1998 | Matsumoto et al. |
| 5,769,716 | A | 6/1998 | Saffari et al. |
| 5,772,506 | A | 6/1998 | Marks et al. |
| 5,781,647 | A | 7/1998 | Fishbine et al. |
| 5,788,573 | A | 8/1998 | Baerlocher et al. |
| 5,788,574 | A | 8/1998 | Ornstein et al. |
| 5,794,964 | A | 8/1998 | Jones et al. |
| 5,795,225 | A | 8/1998 | Jones et al. |
| 5,806,846 | A | 9/1998 | Lofink et al. |
| 5,816,575 | A | 10/1998 | Keller |
| 5,823,873 | A | 10/1998 | Moody |
| 5,823,874 | A | 10/1998 | Adams |
| 5,830,063 | A | 11/1998 | Byrne |
| 5,833,536 | A | 11/1998 | Davids et al. |
| 5,833,537 | A | 11/1998 | Barrie |
| 5,839,730 | A | 11/1998 | Pike |
| 5,845,906 | A | 12/1998 | Wirth |
| 5,848,932 | A | 12/1998 | Adams |
| 5,851,011 | A | 12/1998 | Lott |
| 5,851,148 | A | 12/1998 | Brune et al. |
| 5,855,515 | A | 1/1999 | Pease et al. |
| 5,857,678 | A | 1/1999 | Coleman et al. |
| 5,863,041 | A | 1/1999 | Boylan et al. |
| 5,873,781 | A | 2/1999 | Keane |
| 5,882,261 | A | 3/1999 | Adams |
| 5,890,962 | A | 4/1999 | Takemoto |
| 5,893,718 | A | 4/1999 | O'Donnell |
| 5,911,418 | A | 6/1999 | Adams |
| 5,911,419 | A | 6/1999 | Delaney et al. |
| 5,911,626 | A | 6/1999 | McCrea, Jr. |
| 5,927,714 | A | 7/1999 | Kaplan |
| 5,935,002 | A | 8/1999 | Falciglia |
| 5,941,769 | A | 8/1999 | Order |
| 5,947,820 | A | 9/1999 | Morro et al. |
| 5,947,822 | A | 9/1999 | Weiss |
| 5,951,397 | A | 9/1999 | Dickinson |
| 5,957,776 | A | 9/1999 | Hoehne |
| 5,967,894 | A | 10/1999 | Kinoshita et al. |
| 5,976,016 | A | 11/1999 | Moody et al. |
| 5,980,384 | A | 11/1999 | Barrie |
| 5,984,310 | A | 11/1999 | English |
| 5,997,401 | A | 12/1999 | Crawford |
| 6,007,066 | A | 12/1999 | Moody |
| 6,012,719 | A | 1/2000 | Webb |
| 6,015,346 | A | 1/2000 | Bennett |
| 6,019,369 | A | 2/2000 | Nakagawa et al. |
| 6,039,650 | A | 3/2000 | Hill |
| 6,047,963 | A | 4/2000 | Pierce et al. |
| 6,050,895 | A | 4/2000 | Luciano, Jr. et al. |
| 6,056,641 | A | 5/2000 | Webb |
| 6,056,642 | A | 5/2000 | Bennett |
| 6,059,289 | A | 5/2000 | Vancura |
| 6,059,658 | A | 5/2000 | Mangano et al. |
| 6,062,981 | A | 5/2000 | Luciano, Jr. |
| 6,089,976 | A | 7/2000 | Schneider et al. |
| 6,089,978 | A | 7/2000 | Adams |
| 6,093,102 | A | 7/2000 | Bennett |
| 6,095,525 | A | 8/2000 | Terminel |
| 6,102,400 | A | 8/2000 | Scott et al. |
| 6,102,798 | A | 8/2000 | Bennett |
| 6,110,039 | A | 8/2000 | Oh |
| 6,110,041 | A | 8/2000 | Walker et al. |
| 6,110,043 | A | 8/2000 | Olsen |
| 6,117,012 | A | 9/2000 | McCrea, Jr. |
| 6,120,031 | A | 9/2000 | Adams |
| 6,120,377 | A | 9/2000 | McGinnis, Sr. et al. |
| 6,126,541 | A | 10/2000 | Fuchs |
| 6,126,542 | A | 10/2000 | Fier |
| 6,126,547 | A | 10/2000 | Ishimoto |
| 6,131,908 | A | 10/2000 | Palmer |
| 6,135,884 | A | 10/2000 | Hedrick et al. |
| 6,135,885 | A | 10/2000 | Lermusiaux |
| 6,139,013 | A | 10/2000 | Pierce et al. |
| 6,142,873 | A | 11/2000 | Weiss et al. |
| 6,142,874 | A | 11/2000 | Kodachi et al. |
| 6,146,273 | A | 11/2000 | Olsen |
| 6,155,925 | A | 12/2000 | Giobbi et al. |
| 6,159,095 | A | 12/2000 | Frohm et al. |
| 6,159,096 | A | 12/2000 | Yoseloff |
| 6,159,097 | A | 12/2000 | Gura |
| 6,159,098 | A | 12/2000 | Slomiany et al. |
| 6,165,069 | A | 12/2000 | Sines et al. |
| 6,165,070 | A | 12/2000 | Nolte et al. |
| 6,174,233 | B1 | 1/2001 | Sunaga et al. |
| 6,174,235 | B1 | 1/2001 | Walker et al. |
| 6,179,291 | B1 | 1/2001 | Vancura |
| 6,186,894 | B1 | 2/2001 | Mayeroff |
| 6,190,255 | B1 | 2/2001 | Thomas et al. |
| 6,203,010 | B1 | 3/2001 | Jorasch et al. |
| 6,210,279 | B1 | 4/2001 | Dickinson |
| 6,220,593 | B1 | 4/2001 | Pierce et al. |
| 6,220,961 | B1 | 4/2001 | Keane et al. |
| 6,224,482 | B1 | 5/2001 | Bennett |
| 6,224,484 | B1 | 5/2001 | Okuda et al. |
| 6,227,969 | B1 | 5/2001 | Yoseloff |
| 6,231,442 | B1 | 5/2001 | Mayeroff |
| 6,231,445 | B1 | 5/2001 | Acres |

6,234,897 B1 5/2001 Frohm et al.
6,237,917 B1 5/2001 Timpano
6,238,288 B1 5/2001 Walker et al.
6,261,177 B1 7/2001 Bennett
6,267,669 B1 7/2001 Luciano, Jr. et al.
6,270,409 B1 8/2001 Shuster
6,270,412 B1 8/2001 Crawford et al.
6,293,866 B1 9/2001 Walker et al.
6,299,536 B1 10/2001 Hill
6,305,686 B1 10/2001 Perrie et al.
6,309,298 B1 10/2001 Gerow
6,309,299 B1 10/2001 Weiss
6,312,330 B1 11/2001 Jones et al.
6,312,334 B1 11/2001 Yoseloff
6,313,871 B1 11/2001 Schubert
6,334,814 B1 1/2002 Adams
6,336,859 B2 1/2002 Jones et al.
6,336,862 B1 1/2002 Byrne
6,345,824 B1 2/2002 Selitzky
6,346,044 B1 2/2002 McCrea, Jr.
6,347,996 B1 2/2002 Gilmore et al.
6,371,867 B1 4/2002 Webb
6,375,189 B1 4/2002 Jones
6,386,977 B1 5/2002 Hole
6,398,644 B1 6/2002 Perrie et al.
6,402,147 B1 6/2002 Lo
6,416,409 B1 7/2002 Jordan
6,419,583 B1 7/2002 Crumby et al.
6,425,823 B1 7/2002 Byrne
6,428,412 B1 8/2002 Anderson et al.
6,435,511 B1 8/2002 Vancura et al.
6,443,837 B1 9/2002 Jaffe et al.
6,460,848 B1 10/2002 Soltys et al.
6,461,240 B1 10/2002 Perkins
6,461,241 B1 10/2002 Webb et al.
6,464,582 B1 10/2002 Baerlocher et al.
6,471,591 B1 10/2002 Crumby
6,474,646 B1 11/2002 Webb
6,475,088 B1 11/2002 Jones et al.
6,481,713 B2 11/2002 Perrie et al.
6,482,089 B2 11/2002 Demar et al.
6,485,368 B2 11/2002 Jones et al.
6,503,145 B1 1/2003 Webb
6,511,068 B1 1/2003 Sklansky et al.
6,514,140 B1 2/2003 Storch
6,517,073 B1 2/2003 Vancura
6,517,435 B2 2/2003 Soltys et al.
6,523,831 B2 2/2003 Webb
6,530,837 B2 3/2003 Soltys et al.
6,532,291 B1 3/2003 McGrath
6,533,276 B2 3/2003 Soltys et al.
6,533,658 B1 3/2003 Walker et al.
6,533,662 B2 3/2003 Soltys et al.
6,537,150 B1 3/2003 Luciano et al.
6,547,242 B1 4/2003 Sugiyama et al.
6,553,276 B2 4/2003 Akram et al.
6,569,015 B1 5/2003 Baerlocher et al.
6,572,471 B1 6/2003 Bennett
6,579,180 B2 6/2003 Soltys et al.
6,607,195 B2 8/2003 Vancura
6,609,711 B1 8/2003 Campbell
6,648,759 B2 11/2003 Vancura
6,652,378 B2 11/2003 Cannon et al.
6,645,073 B2 12/2003 Lemay et al.
6,656,040 B1 12/2003 Brosnan et al.
6,656,047 B1 12/2003 Tarantino et al.
6,672,975 B1 1/2004 Galloway
6,682,419 B2 1/2004 Webb et al.
6,682,420 B2 1/2004 Webb et al.
6,692,003 B2 2/2004 Potter et al.
6,692,355 B2 2/2004 Baerlocher et al.
6,702,289 B1 3/2004 Feola
6,726,427 B2 4/2004 Jarvis et al.
6,733,389 B2 5/2004 Webb et al.
6,749,200 B2 6/2004 Yurkins
6,758,751 B2 7/2004 Soltys et al.
6,772,975 B2 8/2004 Sommerfeld et al.
6,776,415 B2 8/2004 Robinson et al.
6,789,800 B2 9/2004 Webb
6,802,773 B2 10/2004 Moody
6,808,173 B2 10/2004 Snow
6,827,348 B1 12/2004 Mitchell
6,840,517 B2 1/2005 Snow et al.
6,845,981 B1 1/2005 Ko
6,848,994 B1 2/2005 Knust et al.
6,857,958 B2 2/2005 Osawa
6,869,074 B2 3/2005 Miller
6,869,075 B1 3/2005 Stavinsky
6,874,786 B2 4/2005 Bruno et al.
6,877,748 B1 4/2005 Patroni et al.
6,878,064 B2 4/2005 Huang
6,884,168 B2 4/2005 Wood et al.
6,896,620 B1 5/2005 Luciano et al.
6,902,167 B2 6/2005 Webb
6,923,446 B2 8/2005 Snow
6,938,900 B2 9/2005 Snow
7,011,309 B2 3/2006 Soltys et al.
7,017,805 B2 3/2006 Meehan
7,018,291 B1 3/2006 Lemke et al.
7,114,718 B2 10/2006 Grauzer et al.
7,137,630 B2 11/2006 Yurkins
2001/0000933 A1 5/2001 Koelling
2001/0035610 A1 11/2001 Webb
2001/0054796 A1 12/2001 Lo
2002/0028710 A1 3/2002 Ishihara et al.
2002/0034974 A1 3/2002 Wood et al.
2002/0042298 A1 4/2002 Soltys et al.
2002/0042299 A1 4/2002 Soltys et al.
2002/0045472 A1 4/2002 Adams
2002/0068625 A1 6/2002 Soltys et al.
2002/0072405 A1 6/2002 Soltys et al.
2002/0072407 A1 6/2002 Soltys et al.
2002/0094855 A1 7/2002 Berman
2002/0177480 A1 11/2002 Rowe
2002/0198036 A1 12/2002 Baerlocher et al.
2003/0057648 A1 3/2003 Webb
2003/0064772 A1 4/2003 Tempest et al.
2003/0064785 A1 4/2003 Stone et al.
2003/0069064 A1 4/2003 Ainsworth
2003/0071418 A1 4/2003 Saucier
2003/0087696 A1 5/2003 Soltys et al.
2003/0151194 A1 8/2003 Hessing et al.
2003/0171142 A1 9/2003 Kaji et al.
2003/0181231 A1 9/2003 Vancura et al.
2003/0207709 A1 11/2003 Paotrakul
2003/0207710 A1 11/2003 Rodgers et al.
2003/0211884 A1 11/2003 Gauselmann
2003/0236116 A1 12/2003 Marks et al.
2004/0029631 A1 2/2004 Duhamel
2004/0053673 A1 3/2004 Mishra
2004/0053681 A1* 3/2004 Jordan et al. ..... 463/20
2004/0053683 A1 3/2004 Hartl et al.
2004/0056418 A1 3/2004 Wirth
2004/0056419 A1 3/2004 Wirth
2004/0061288 A1 4/2004 Snow
2004/0070146 A1 4/2004 Snow
2004/0072619 A1 4/2004 Brosnan et al.
2004/0152509 A1 8/2004 Hornik et al.
2004/0164491 A1 8/2004 Webb
2004/0183256 A1 9/2004 Ko
2004/0195770 A1 10/2004 Ornstein
2004/0224777 A1 11/2004 Smith et al.
2004/0251630 A1 12/2004 Sines et al.
2005/0012273 A1 1/2005 Bruno et al.
2005/0026680 A1 2/2005 Gururajan
2005/0026683 A1 2/2005 Fujimoto
2005/0029743 A1 2/2005 Daines
2005/0032563 A1 2/2005 Sines
2005/0032564 A1 2/2005 Sines
2005/0037837 A1* 2/2005 Rowe ..... 463/25
2005/0051963 A1 3/2005 Snow
2005/0054408 A1 3/2005 Steil et al.
2005/0054430 A1* 3/2005 Pitman et al. ..... 463/25
2005/0059461 A1 3/2005 Ching et al.
2005/0073100 A1 4/2005 Falciglia et al.
2005/0073102 A1 4/2005 Yoseloff et al.
2005/0082758 A1 4/2005 Sklansky et al.
2005/0116414 A1 6/2005 Yurkins

| | | | |
|---|---|---|---|
| 2005/0119047 | A1 | 6/2005 | Olive |
| 2005/0119048 | A1 | 6/2005 | Soltys et al. |
| 2005/0143168 | A1 | 6/2005 | Torango |
| 2005/0161882 | A1 | 7/2005 | Miller |
| 2005/0164760 | A1 | 7/2005 | Moody |
| 2005/0176488 | A1 | 8/2005 | Olive |
| 2005/0209004 | A1 | 9/2005 | Torango |
| 2005/0239542 | A1 | 10/2005 | Olsen |
| 2005/0269776 | A1 | 12/2005 | Miller |
| 2005/0277463 | A1 | 12/2005 | Knust et al. |
| 2005/0282622 | A1 | 12/2005 | Lindquist |
| 2006/0001211 | A1 | 1/2006 | Lewis et al. |
| 2006/0019739 | A1 | 1/2006 | Soltys et al. |
| 2006/0027970 | A1 | 2/2006 | Kyrychenko |
| 2006/0058082 | A1 | 3/2006 | Crawford, III et al. |
| 2006/0058083 | A1 | 3/2006 | Crawford, III et al. |
| 2006/0058084 | A1 | 3/2006 | Crawford, III et al. |
| 2006/0058085 | A1 | 3/2006 | White et al. |
| 2006/0058086 | A1 | 3/2006 | White et al. |
| 2006/0058087 | A1 | 3/2006 | White et al. |
| 2006/0058088 | A1 | 3/2006 | Crawford, III et al. |
| 2006/0058089 | A1 | 3/2006 | White et al. |
| 2006/0058090 | A1 | 3/2006 | Crawford, III et al. |
| 2006/0058091 | A1 | 3/2006 | Crawford, III et al. |
| 2006/0058092 | A1 | 3/2006 | Crawford, III et al. |
| 2006/0058093 | A1 | 3/2006 | White et al. |
| 2006/0066052 | A1 | 3/2006 | White et al. |
| 2006/0068495 | A1 | 3/2006 | Tessie et al. |
| 2006/0068864 | A1 | 3/2006 | White et al. |
| 2006/0068865 | A1 | 3/2006 | White et al. |
| 2006/0068866 | A1 | 3/2006 | White et al. |
| 2006/0068868 | A1 | 3/2006 | Crawford, III et al. |
| 2006/0068869 | A1 | 3/2006 | White et al. |
| 2006/0068870 | A1 | 3/2006 | Crawford, III et al. |
| 2006/0068871 | A1 | 3/2006 | Crawford, III et al. |
| 2006/0068879 | A1 | 3/2006 | Crawford, III et al. |
| 2006/0068899 | A1 | 3/2006 | White et al. |
| 2006/0160600 | A1 | 7/2006 | Hill et al. |
| 2006/0160608 | A1 | 7/2006 | Hill et al. |
| 2006/0165254 | A1 | 7/2006 | Fujimoto et al. |
| 2006/0177109 | A1 | 8/2006 | Storch |
| 2006/0202422 | A1 | 9/2006 | Bahar |
| 2006/0223638 | A1 | 10/2006 | Koyama et al. |
| 2006/0252521 | A1 | 11/2006 | Gururajan et al. |
| 2006/0252554 | A1 | 11/2006 | Gururajan et al. |
| 2006/0258427 | A1 | 11/2006 | Rowe et al. |
| 2006/0258442 | A1 | 11/2006 | Ryan |
| 2006/0264252 | A1 | 11/2006 | White et al. |
| 2006/0277100 | A1* | 12/2006 | Parham ..... 705/14 |
| 2006/0287066 | A1 | 12/2006 | Crawford, III et al. |
| 2006/0287067 | A1 | 12/2006 | White et al. |
| 2006/0287101 | A1 | 12/2006 | Crawford, III et al. |
| 2006/0287102 | A1 | 12/2006 | White et al. |
| 2006/0287103 | A1 | 12/2006 | Crawford, III et al. |
| 2006/0287104 | A1 | 12/2006 | White et al. |
| 2006/0293099 | A1 | 12/2006 | Cooper |

FOREIGN PATENT DOCUMENTS

| | | | |
|---|---|---|---|
| EP | 0 874 337 | | 10/1998 |
| EP | 0 945 837 | | 9/1999 |
| EP | 0 984 408 | | 3/2000 |
| EP | 0 984 409 | | 3/2000 |
| EP | 1 469 432 | | 4/2004 |
| EP | 1 532 594 | | 11/2006 |
| GB | 2 096 376 | A | 10/1982 |
| GB | 2 097 160 | A | 10/1982 |
| GB | 2 100 905 | A | 1/1983 |
| GB | 2 117 952 | | 10/1983 |
| GB | 2 137 392 | A | 10/1984 |
| GB | 2 142 457 | A | 1/1985 |
| GB | 2 153 572 | A | 8/1985 |
| GB | 2 161 008 | A | 1/1986 |
| GB | 2 161 009 | A | 1/1986 |
| GB | 2 170 636 | A | 8/1986 |
| GB | 2 180 682 | A | 4/1987 |
| GB | 2 181 589 | A | 4/1987 |
| GB | 2 183 882 | A | 6/1987 |
| GB | 2 191 030 | | 12/1987 |
| GB | 2 222 712 | A | 3/1990 |
| GB | 2 226 907 | A | 7/1990 |
| GB | 2 408 951 | | 6/2005 |
| WO | WO 98/47115 | | 10/1998 |
| WO | WO 98/51384 | | 11/1998 |
| WO | WO 00/12186 | | 3/2000 |
| WO | WO 2004/021294 | | 3/2004 |
| WO | WO 2004/112923 | | 12/2004 |
| WO | WO 2005/009563 | | 2/2005 |
| WO | WO 2005/025696 | | 3/2005 |
| WO | WO 2005/025701 | | 3/2005 |
| WO | WO 2005/037385 | | 4/2005 |
| WO | WO 2005/043475 | | 5/2005 |
| WO | WO 2005/081958 | | 9/2005 |
| WO | WO 2005/083599 | | 9/2005 |
| WO | WO 2005/099425 | | 10/2005 |
| WO | WO 2005/123203 | | 12/2005 |
| WO | WO 2006/041655 | | 4/2006 |
| WO | WO 2006/106192 | | 10/2006 |
| WO | WO 2006/127128 | | 11/2006 |

OTHER PUBLICATIONS

Advantage Casino System Brochure, Mobile Data Access, written by IGT, available prior to Aug. 30, 2005.

Advantage Casino System Brochure, NexGen Interactive Touch Screen Display, written by IGT, available prior to Aug. 30, 2005.

Advantage Casino System Marketing Brochure, written by IGT, available prior to Aug. 30, 2005.

Advantage Casino System Table Touch Brochure, written by IGT, 2004.

Bingo Game Brochure written by Casino Data System/published in 1998.

Description of Poker written by Hoyle's Rules of Games published 1946-1983.

Fortune Cookie Brochure written by IGT/published in 2000.

Full House Brochure written by Anchor Games/published in 2000.

Jackpot Bingo written by CDS.com/printed Apr. 12, 2001.

Jewel in the Crown Brochure written by Barcrest/Ltd/ available prior to Aug. 30, 2005.

Match Reel Game Bonus Description written by IGT/ available prior to Aug. 30, 2005.

Mikohn Ripley's Believe It or Not Article written by Strictly Slots published in 2001.

Payday Poker Article written by Bally Gaming Systems/published in 2005.

Plinko Showcase Show Down written by International Game Technology/published in 2001.

Slot Bingo Wagering Description and Paytable written by IGT/ available prior to Aug. 30, 2005.

Take Your Pick Brochure and Article written by IGT/Anchor Games, Strictly Slots, published in 1999.

Tetris Game Description written by Radica/published in 2000.

Top Dollar Brochure written by IGT published in 1998.

* cited by examiner

SYSTEM AND METHOD FOR PROVIDING POKER PLAYER TRACKING AND BONUS EVENTS

PRIORITY CLAIM

This application is a divisional application of U.S. patent application Ser. No. 11/215,474, filed on Aug. 30, 2005, the entire contents of which are incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

In recent years poker has become very popular. Gaming establishments are increasingly offering poker rooms that include many live gaming tables where players can play against each other. In return for providing these gaming tables and services to the players, the casinos generally take a small percentage of the total amounts wagered in each hand. This percentage is generally referred to as the rake and the amount represents a fair return to the casino for providing these services to the players. Despite the current popularity of poker, many gaming establishments do not realize the full profit potential of the gaming tables because poker seats remain empty, because there is not enough advertised interest in the poker room, or because the games do not hold the player's interest over an extended period of time. Also, when the poker room is busy, players may be frustrated by having to wait in line in order to get a seat at the table.

In general, poker hands consist of five cards dealt from a 52 card deck. There are nine general categories of hands, ranked from highest to lowest, as shown in Table 1.

TABLE 1

Ranking of Poker Hands by Category

| Rank | Name | Example |
|---|---|---|
| 1 | Straight Flush | K♣Q♣J♣10♣9♣ |
| 2 | Four of a Kind | J♣J♥J♦J♠3♣ |
| 3 | Full House | A♥A♦A♣6♦6♣ |
| 4 | Flush | A♣J♣8♣6♣2♣ |
| 5 | Straight | 8♦7♣6♠5♠4♣ |
| 6 | Three of a Kind | Q♠Q♥Q♦6♦2♠ |
| 7 | Two Pair | 8♦8♥5♥5♣2♠ |
| 8 | One Pair | K♦K♠8♠7♣2♥ |
| 9 | No Pair | A♥10♣7♦5♠3♠ |

Within each category, hands are ranked according to the rank of individual cards, with an Ace being the highest card and a two being the lowest card. There is no difference in rank between the four suits of cards. All hands can be ranked in a linear ranking from highest to lowest. Because suits are all of the same value, however, there are multiple hands that have identical rankings. For example, there are four equivalent hands for each type of straight flush, four of a kind, or flush, there are over a hundred equivalent hands for each two pair variation, and there are over 1,000 equivalent hands for each type of no-pair hand.

Poker is characterized by rounds of card dealing and wagering. Numerous variations of poker exist, including Five Card Draw, Five Card Stud, Seven Card Stud, Hold'em (also called Texas Hold'em), Omaha (also called Omaha Hold'em), and Pai-Gow. The variations in these games generally differ in the manner in which cards are dealt and in the manner and frequency in which bets are placed. Various criteria may also be used to determine the winning hand, including highest ranking hand, lowest ranking hand (Low-Ball), and high and low hands each win half (High-Low).

In certain variations of poker, a round of play begins when each player has placed an initial bet, called the ante, into the pot. The term pot refers to the total accumulation of antes and wagers made during a particular game. However, in other poker variations, such as Texas Hold'em, only two players at a table make the initial bets, commonly referred to as blinds. These blinds include a large blind and a small blind. The large blind is typically twice the value of the small blind. In a blind based game, all players are eligible to play, even if they did not initially place the large blind or the small blind. After the players have anted or placed the blinds, depending on the game, each player eligible for play is dealt an initial set of cards.

The number of cards dealt depends on the particular variation of poker being played. For example, in Five Card Draw, each player is initially dealt five cards. In Texas Hold'em, Five Card Stud and Seven Card Stud, each player is initially dealt two cards. These cards are typically dealt face-down; however, depending on the game, some of the cards may be dealt face-up to the player. For example, in Five Card Stud, each player is initially dealt one card face-up and one card face-down. In Texas Hold'em, each player is initially dealt two cards face-down which are commonly referred to as the hole cards.

After the initial deal, a first round of betting begins, where the players have the opportunity to place wagers. If a player places a wager, that wager must be matched (i.e., called) or raised by each player that wants to remain in the game. A raise includes matching the previous wager and increasing the total bet. A player who does not match a bet drops out of the game or folds. A round of betting ends when either every player but one has folded, or when the highest bet or raise has been called by each remaining player such that each remaining player has wagered the same amount into the pot during the round.

Depending on the variation of poker being player, each game may have several rounds of wagering, each round of wagering generally preceded by dealing one or more cards. If two or more players remain after a particular round of wagering, either more cards are dealt, or there is a showdown, depending on the game variation being played. A showdown occurs when two or more players remain in a game after the last round of wagering has been completed for a particular round. A player wins a game of poker either by having the highest ranking hand when a showdown occurs, or by being the last remaining player in the game after all other players have dropped out, or folded. At a showdown, each player displays the player's hand to the other players. If two or more players have identically ranked hands that are the highest ranking hands, the pot is split evenly between them.

Gaming establishments have long recognized that progressive jackpots tend to increase excitement and hold a player's interest in a game. Recent developments in live gaming table technology include the incorporation of a progressive jackpot feature. For example, one system provides a live card game that includes a progressive jackpot feature, where a player becomes eligible to win the progressive jackpot by making an optional additional wager. The additional wager funds the progressive jackpot. Another known system provides for an optional progressive wager, where the gaming table includes a separate coin acceptor at each player position that is operable to receive an optional progressive bet. In another system, a gaming table includes an apparatus operable to receive the optional progressive game token and to control a jackpot meter. The apparatus is built into the game table and any number of tables can be networked together for a single progressive jackpot.

A common characteristic of all of the above approaches that include conventional progressive systems for live gaming tables, is the requirement that each player must place a separate optional progressive wager. Therefore, participation in the progressive jackpot feature is at the option of the player, and contributions are only made to the progressive jackpot when a player makes the optional wager. Furthermore, the variety of progressive table games is limited and they do not adequately reward the frequent players.

In addition to recognizing the value of progressive jackpots, gaming establishments have also recognized the value of building customer loyalty through identifying frequent customers and rewarding them for their patronage. These rewards are typically referred to as comping. To properly identify customers that are deserving of special comp rewards, automated player tracking technologies exist to accurately identify these individuals. The cumulative history of a particular player's gaming activity, which is included in a player profile, enables gaming establishments to target individual players with direct marketing promotions or customized compensation plans.

In existing player tracking systems, a player is issued a player identification card which has an encoded player identification number that uniquely identifies the player. Player tracking on gaming devices such as slot machines, is typically accomplished with a card reader mounted to the gaming device. When the player first sits down at a gaming machine, the player inserts the card into the card reader. The reader reads the player identification number off the card and communicates information through a network to a central computer regarding the player's subsequent gaming activity.

Subsequent systems have adapted the card reader technology to live gaming tables. Existing live gaming table tracking systems include magnetic stripe card readers mounted to the table for entering player identification information on the magnetic stripe cards. In certain of these systems, wagering information is entered by a pit boss using a touch screen mounted to the table. These systems require a manual data entry of the wagers, and thus do not fully automate data collection for player tracking.

Other systems have enhanced tracking systems for live gaming tables that incorporate chip identifiers and card identifiers. These technologies help to further automate the tracking and comping process. One example of an optical chip reading technology includes mounting a black and white CCD sensor into a reading turret placed in proximity to a player's wagering area. In this system, each wagering chip includes patterns of repeated coding around the periphery of the chip. The patterns are identifiable by the CCD sensor. Therefore, the gaming system is able to determine the amount of each wager by imaging all of the chips and associating the patterns with a chip value.

One example of a playing card identifier is described in U.S. Patent Application No. 2003/0171142 to Toshiyuki et al., which discloses a card data reader where the card data recorded on the back of the playing card will be read by an internal image sensor. Another example of tracking technology is described in U.S. Patent Application No. 2002/0049085 to Richard et al. ("Richard"), which discloses a table monitor that automatically images the activity occurring at a gaming table. The Richard application describes an imaging system that makes a periodic comparison of captured images identifying player wagering, as well as the appearance, removal and position of cards and other game objects on the gaming table. Therefore, a card tracking system enables the casino to automatically track cards dealt to a player and wagering patterns, and store the information into memory.

Although gaming establishments are able to comp frequent players based on information obtained from tracking systems on live gaming tables, the gaming tables do not include progressive jackpot features. Also, the progressive jackpot features are not funded by a portion of the rake. Furthermore, gaming tables that include progressive jackpot features do not provide a jackpot award based, in part, on tracked cards and/or historical game play information obtained through a tracking system.

A need exists for a progressive jackpot system for live gaming tables that permits progressive jackpot awards while minimizing interference with the conventional play of the game by not requiring a separate progressive wager.

A need exists for new progressive jackpot features for live gaming tables where the jackpot features are, at least in part, related to player tracking information and where the jackpot award effectively reward (i.e., comp) a player for frequent play.

SUMMARY

One embodiment of the present disclosure provides a gaming system including a processor, a gaming table for a card game, and a progressive jackpot funded by a portion of the house rake. More specifically, the gaming table includes a plurality of player positions, a dealer position, at least one wagering area, and at least one display device operable to display the progressive jackpot award, wherein the card game employs at least one deck of playing cards. The deck of playing cards may be a standard fifty-two card deck, or may be any other suitable type of deck, such as a forty-eight card Pinochle deck, and may further include Jokers or Wild cards. The progressive jackpot is awarded to a player if a player satisfies a predetermined set of criteria. Therefore, in the gaming system of this embodiment, every player at the table is automatically qualified to win the progressive jackpot award without having to place a separate additional wager. This adds excitement to the game and encourages more players to participate at the gaming table.

In one embodiment, the house rake is automatically calculated. The gaming system includes a gaming table with a tracking system, where the tracking system includes at least one chip identifier. The chip identifier identifies the amount of each wager placed in one or more wagering area and the tracking system communicates this information to a central processor. The processor calculates the value of the rake, based in part, on the sum of all wagers identified by the tracking system. Therefore, the calculated rake enables the dealer to determine and remove the rake from the table (at the end of the game) and functions as a check and balance against the manual chip count. This enables the casino to track at least part of the revenue from the gaming room. In one embodiment, the gaming system also includes a progressive jackpot that is funded by a portion of the house rake. Because the rake is automatically calculated based on information obtained from the tracking system, the gaming system is operable to apply a predetermined portion of the collected rake to the progressive jackpot and causes this increased award to be updated on a display device. Accordingly, the progressive jackpot award continues to grow without any apparent interference with the game play.

In one embodiment, a gaming system includes a progressive jackpot award that is based on the highest ranking hand achieved during a particular period of time. The gaming system includes a tracking system which includes at least one player identification input device, and a card identifier operable to identify each card dealt to a player position. The tracking system communicates the identity of each card to the processor. At the end of a round of play, the processor updates a player profile associated with the player identification card with the rank of the player's hand. Therefore, the gaming system keeps a record of every hand dealt to a player along with the date and time the hand was dealt. Players that have achieved the high ranking hand are encouraged to continue playing until the progressive jackpot is awarded. Furthermore, if the highest recorded ranking hand can be beaten, other players are encourage to continue playing in hopes of getting an even higher ranking hand. The more hands that a player plays during a particular period of time, the more likely it is that the player will achieve the highest ranking hand. Accordingly, the gaming system of this embodiment tends to reward frequent players and functions as a type of comp. In one embodiment, the period of time is configurable and may include off peak hours. In one embodiment, the progressive jackpot award is funded by a portion of the rake, as mentioned above.

In one embodiment, a gaming system includes a gaming table and a progressive jackpot award. The gaming system includes a tracking system, as described above, to keep a record of every hand played and the time the hands were played. In this embodiment, the progressive jackpot award is provided to a randomly selected player if the player is actively registered at the gaming system and if the player profile indicates that the player had placed at least one wager during a previous period of time. Therefore, this system rewards frequent players and encourages people to come back and play at later times. In one embodiment, the previous period of time may be during off peak hours to encourage play during slow periods.

In one embodiment, the gaming system includes a table configured for a poker game and includes a progressive jackpot that is awarded to a player achieving one of several high ranking poker hands (e.g., Four of a Kind or a Straight Flush), where the progressive jackpot is funded by a portion of the rake. In one embodiment, the poker game includes dealing at least one hole card and at least one community card. In this embodiment, the progressive jackpot award is provided to the player that has achieved a predetermined combination of cards utilizing the player's hole cards. Therefore, the progressive feature of this embodiment provides excitement to a player that has first been dealt one or more hole cards that could potentially form one of the predetermined high ranking hands. This adds an additional twist to the game, because a poker player that is dealt qualifying hole cards may reveal their excitement to other players at table. Other players at the table may have an advantage by being able to determine what cards the player is holding.

In one embodiment, a gaming system includes a progressive jackpot feature for a no-limit poker game. In this embodiment, the gaming system randomly selects a player at a particular point in time. The jackpot award is provided to the randomly selected player if that player has wagered all of their chips and subsequently loses the hand. Therefore, a player that has lost all of their chips has the possibility of being compensated by winning a potentially large jackpot. Also, this may encourage more players to risk going all-in in the hope of winning a progressive jackpot. In one embodiment, the gaming system causes the display device to display the randomly selected player prior to the player's decision to go all-in. In another embodiment, the jackpot award is provided to a randomly selected player that has gone all-in a predetermined number of times, regardless of whether the player wins or loses each of the hand. Alternatively, the jackpot award is provided to a player that has gone all-in a predetermined number of times and won each hand.

In one embodiment, a gaming system including a table for a card game including a notification system to inform players that a seat at a poker table is vacant. The gaming system includes a notification system operable to identify a vacant player position at the gaming table, retrieve a waiting list of potential players from a database and determine if the first potential player on this waiting list is actively playing at one of a plurality of remote gaming devices or gaming tables. The remote gaming device or remote gaming table must be connected to the card table through a linked network and must include a player identification input device. The notification system causes the processor to send a vacancy notification through the linked network to the potential player playing at the remote gaming device. In one embodiment, the notification may be a message displayed on a the remote gaming device or remote gaming table.

Additional features and advantages are described herein, and will be apparent from the following Detailed Description and the figures.

BRIEF DESCRIPTION OF THE FIGURES

FIG. 2 is a schematic diagram of the data network that one or more of the gaming systems of the present disclosure are connected to.

DETAILED DESCRIPTION

One or more embodiments of the present disclosure comprise a gaming system including a live table game and an activity tracking and reward system. The tracking system is configured to collect and store raw data relating to the wagering activities of players at a gaming table. The present disclosure also includes methods of utilizing the obtained data. For example, the data may be used to calculate the house rake, where the house rake may be based on the size of the pot at the end of a hand. In one embodiment, certain criteria are applied to the obtained data to determine if a player qualifies to receive a progressive jackpot award. In another embodiment, the collected data is analyzed to determine a player's wagering history to determine whether or not the player is entitled to certain complimentary items. In another embodiment, the gaming system notifies a player that a seat is vacant at a poker table, where the player is located at a remote gaming device or gaming table.

Figure 1:
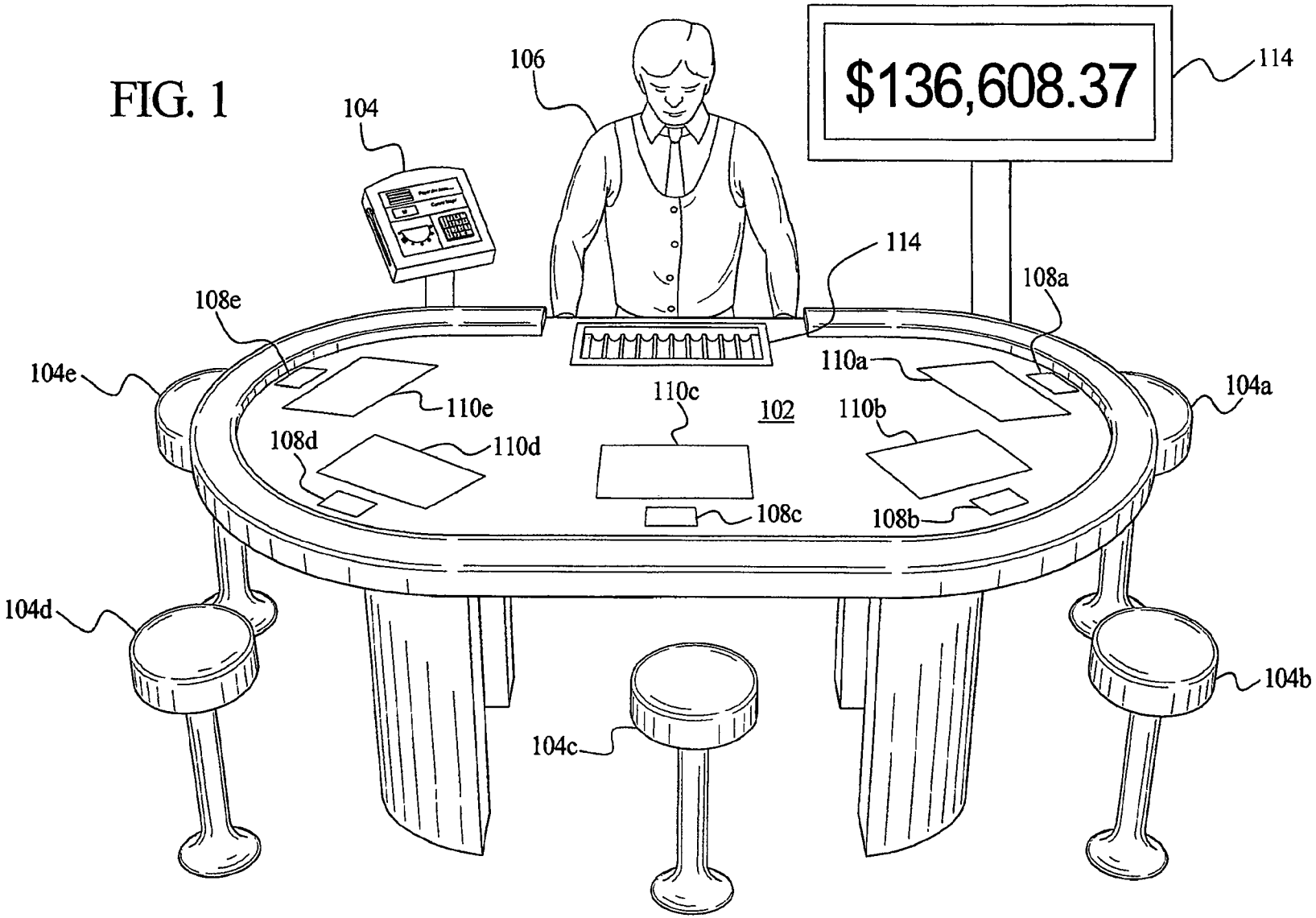
FIG. 1 is a front perspective view of one embodiment of the gaming system of the present disclosure.

As illustrated in FIG. 1, a typical live gaming table includes several components. The gaming table 100 includes a suitable support structure 101, such as one or more legs. The table includes a playing surface 102, a plurality of player positions 104*a*, 104*b*, 104*c*, 104*d* and 104*e*, and a dealer position 104*f*. The gaming table generally includes a chip tray 106 for holding several stacks of the dealer's chips. The dealer may use the chip tray 106 to collect a percentage of chips from the pot according to the house rules. This percentage take is generally referred to as the rake, as described above. The dealer may also use the chip tray to make change for a player or allow a player to buy into a game. In this example, there are five player positions. It should be appreciated that the gaming table could accommodate any suitable number of playing positions and players so as not to interfere with game play.

In one embodiment, the table game includes a plurality of wagering areas 108*a*, 108*b*, 108*c*, 108*d* and 108*e* where all players place their bets. It should be appreciated that the table game may also include a community wagering area (not shown), that includes all the chips in the pot. The table game also includes a plurality of play areas 110*a*, 110*b*, 110*c*, 110*d* and 110*e* associated with each of the player positions. Cards are dealt by the dealer substantially within the respective play areas, such that cards dealt to a first player position are not confused with cards dealt to a second different player position. In the illustrated embodiment, the gaming table includes at least one display device 114 operable to display any active bonus games and/or the current value of one or more progressive jackpots. In another embodiment, the gaming table could include a plurality of display devices each associated with a player position. In the illustrated embodiment, the display device provides information to the player that includes the value of any progressive jackpots.

Figure 2:
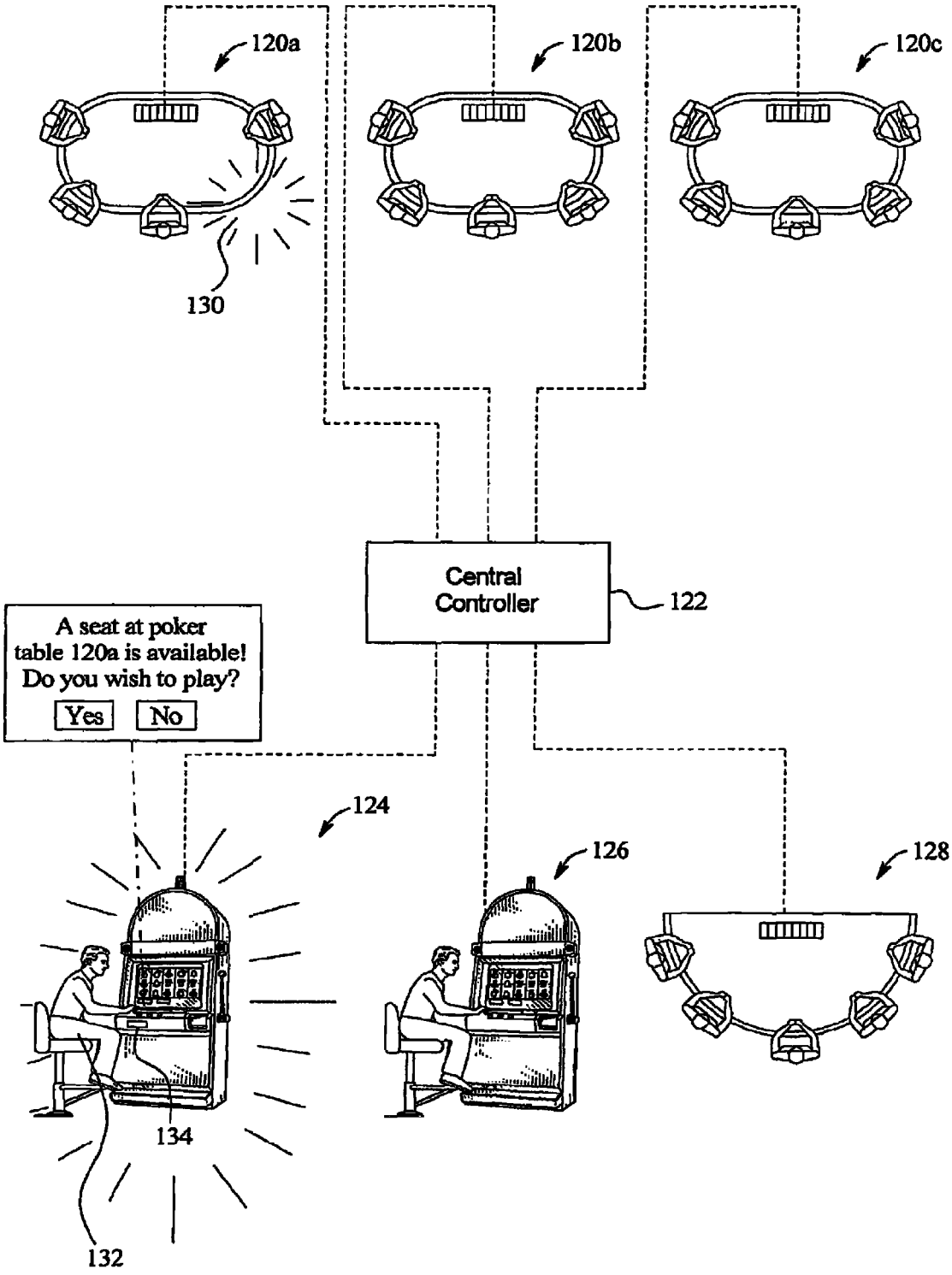

As illustrated in FIG. 2, a plurality of the gaming systems 120*a*, 120*b* and 120*c* are capable of being connected to a data network. In one embodiment, the data network is a local area network (LAN), in which one or more of the gaming systems are substantially proximate to each other and an on-site central server or controller 122 as in, for example, a gaming establishment or a portion of a gaming establishment. In one embodiment, on or more gaming systems may be connected to a plurality of different gaming machines 124 and 126 and/or gaming tables 128. For example, the gaming system may be connected to one or more slot machines, video poker machines, or Blackjack tables, provided that the gaming devices or gaming tables have appropriate player identification input devices, such as a magnetic card reader.

In another embodiment, the data network is a wide area network (WAN) in which one or more of the gaming systems are in communication with at least one off-site central server or controller. In this embodiment, the plurality of gaming systems may be located in a different part of the gaming establishment or within a different gaming establishment than the off-site central server or controller. Thus, the WAN may include an off-site central server or controller and an off-site gaming system located within gaming establishments in the same geographic area, such as a city or state. The WAN gaming system may be substantially identical to the LAN gaming system described above, although the number of gaming systems in each system may vary relative to each other.

In another embodiment, a plurality of gaming systems at one or more gaming sites may be networked to a central server in a progressive configuration, wherein a portion of the rake may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming systems distributed throughout a number of properties at different geographical locations including, for example, different locations within a city or different cities within a state. In one embodiment, a community display device (not shown) displays a progressive award that can be viewed from a plurality of gaming systems. The progressive award may be determined by several rounds of poker, or it may be determined by contributions from different gaming tables throughout the gaming establishment, each gaming table linked through a network, as described above.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming system hardware and software and the host site computer.

Figure 3:
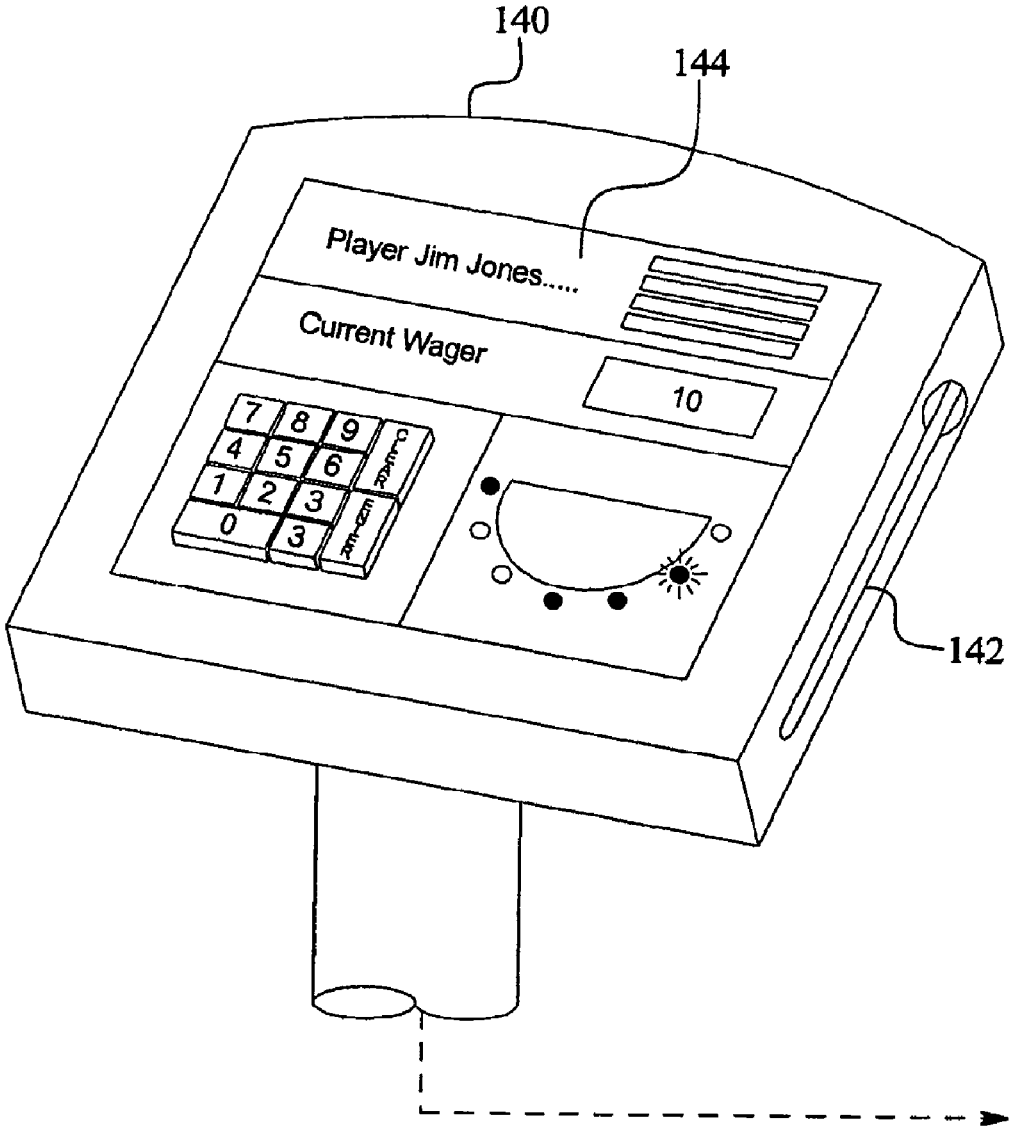
FIG. 3 is a front perspective view of the dealer display device.

In an embodiment, the gaming table is associated with a tracking system. As illustrated in FIG. 3, the tracking system includes at least one computer interface 140 located at each gaming table and which is accessible to the dealer. In one embodiment, the computer interface includes a player identification card reader 142 and a touch screen monitor 144. The touch screen monitor enables a dealer to input information related to a player or the individual wagers. For example, the dealer may manually enter the amount of each wager for each player. It should be appreciated that any suitable method may be used to identify a player or to input wagers.

In another embodiment, the tracking system further includes an automatic chip identifier (not shown) capable of identifying the amount of each wager. The chip identifier may include technology based on RFID or optically based, as described above. In one embodiment, the dealer is able override the chip identification system and manually input a wager. In another embodiment, the tracking system further includes a card identifier operable to identify the cards dealt to each player and communicate the information to the processor.

Gaming Table Vacancy Notification

In one embodiment, where the gaming device includes a tracking system, the gaming table includes an integrated player identification input device operable to check a player into a table. In one example, the input device is a magnetic card reader operable upon swiping a magnetic player identification card (not shown). Therefore, the system is capable of keeping track of the players at a table as well as how many empty seats there are. If all of the gaming tables are full, a processor generates a waiting list for other players wishing to play and stores this into a memory device. Referring back to FIG. 2, in one embodiment, the gaming systems 120*a*, 120*b* and 120*c* are networked to different gaming machines and/or gaming tables throughout the casino, as described above. The gaming machines may be traditional slot machines, video poker games, video Blackjack games, or any other suitable type of gaming machine connected through the network. In this embodiment, if a potential player 132 on the waiting list is playing at another remote gaming machine 124 that includes a player identification input device (not shown), the player can log into the network by inserting their player identification card into said gaming machine. The gaming system 120*a* with the vacant player position 130 causes the processor to provide notification to the potential player 132 through the network that a seat at a gaming table is available. For example, a player may be playing a traditional slot machine on the opposite end of the casino from the table games. In one embodiment, the slot machine includes a display capable of displaying a message informing the player that a poker seat is available and they are next on the waiting list. In one embodiment, the gaming machine 124 further includes an input 136 to allow the player to accept or decline the open seat at the poker table. If the player declines the poker seat, a notification is sent from the remote gaming machine 124 to the gaming table 120*a*. The gaming system then attempts to notify the next potential poker player on the waiting list. This allows for maximum utilization of both the gaming tables and of other gaming devices by limiting the need to wait in line for a gaming table. Moreover, this eliminates or minimizes any player frustration associated with having to wait for a seat in physical proximity to the poker room.

In another embodiment, the display device on the remote gaming device informs the player of the value of any progressive jackpots associated with the gaming system 120*a*. In another embodiment, the gaming establishment provides a number of large community displays (not shown) that indicate the value of any progressive jackpots. Therefore, when the jackpots become large there will be a larger motivation for the player to participate at the gaming tables.

Table Game Progressive Jackpot Funded by the House Rake

Figure 4A:
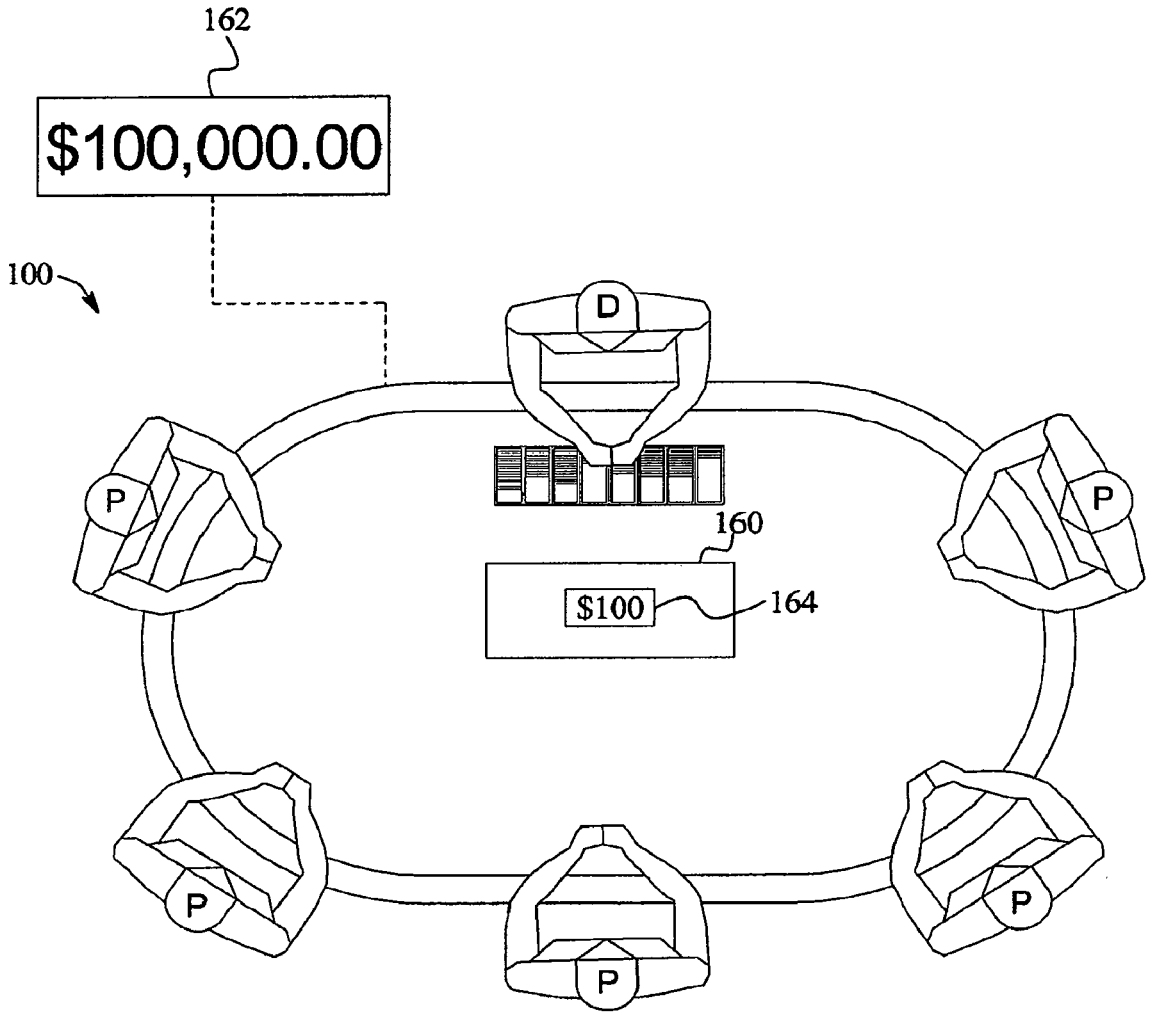
FIGS. 4A and 4B are top views of one embodiment of the gaming system of the present disclosure including a progressive jackpot feature.
Figure 4B:
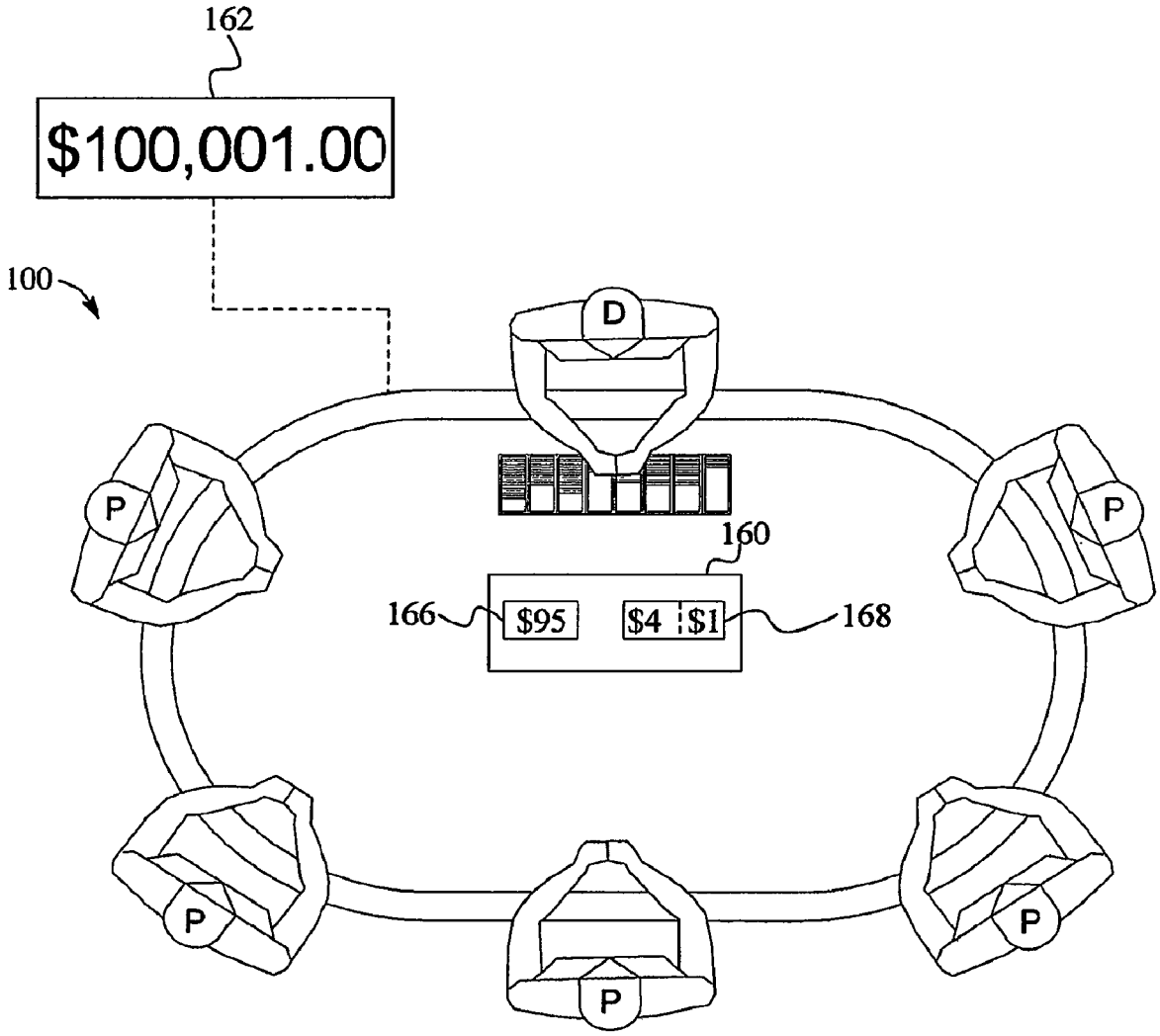

In one embodiment, at least one type of bonus game will be available to all players in the form of a progressive jackpot. The progressive jackpot is funded by a portion of the rake and does not require a separate optional wager by a player. The casino allocates a portion of the rake to be applied to a progressive jackpot in one or more different bonus games. In the example illustrated in FIGS. 4A and 4B, the gaming table 100 includes a wagering area 160 and a progressive jackpot display 162. The progressive jackpot award is initially $100,000.00 as indicated by the progressive jackpot display 162. FIG. 4A illustrates the end of a particular round of a card game where the resultant pot 164 is one-hundred dollars. The house rake for this particular game is 5% of the pot, or $5. However, it should be appreciated that the rake may be determined in any suitable matter, as discussed above. As illustrated in FIG. 4B, 20% of this rake 168 amount, or one dollar, is allocated to the progressive jackpot. However, it should be appreciated that the portion of the house rake may be any suitable amount or percentage, and determined in any suitable manner. The progressive jackpot award increases to $100,001.00, as indicated by the progressive jackpot display 162. Accordingly, the dealer provides the winning player(s) with the resultant pot 166 of ninety-five dollars and the gaming establishment retains four dollars. In one embodiment, several gaming systems are linked together through a network as described above, and a portion of the rake from each table contributes to the progressive jackpot award.

Lose to Win Progressive Jackpot

In one embodiment, a progressive jackpot game is applied to a poker game. In certain poker variations such as Pot Limit or No Limit games, the player often has the option to wager all of their remaining chips. This is commonly referred to as going all-in. In one embodiment, the progressive jackpot is randomly awarded at a particular point in time to a player who has gone all-in and lost all of their chips. The player must have registered at a gaming table at a previous point in time and must also have been continuously playing up to the point in time at which the progressive jackpot is awarded. The player can become registered at a table by swiping a player card into a card reader, as discussed above with reference to FIG. 3. In one example, in order to qualify to win the progressive jackpot award, the player must have been registered at the gaming system at the beginning of the hour. In one example, at five minutes after the hour, a central processor randomly selects a single player position located at one of a plurality of gaming tables. If the selected player had wagered and lost all of their chips, the player would win at least a portion of the progressive jackpot.

Figure 5:
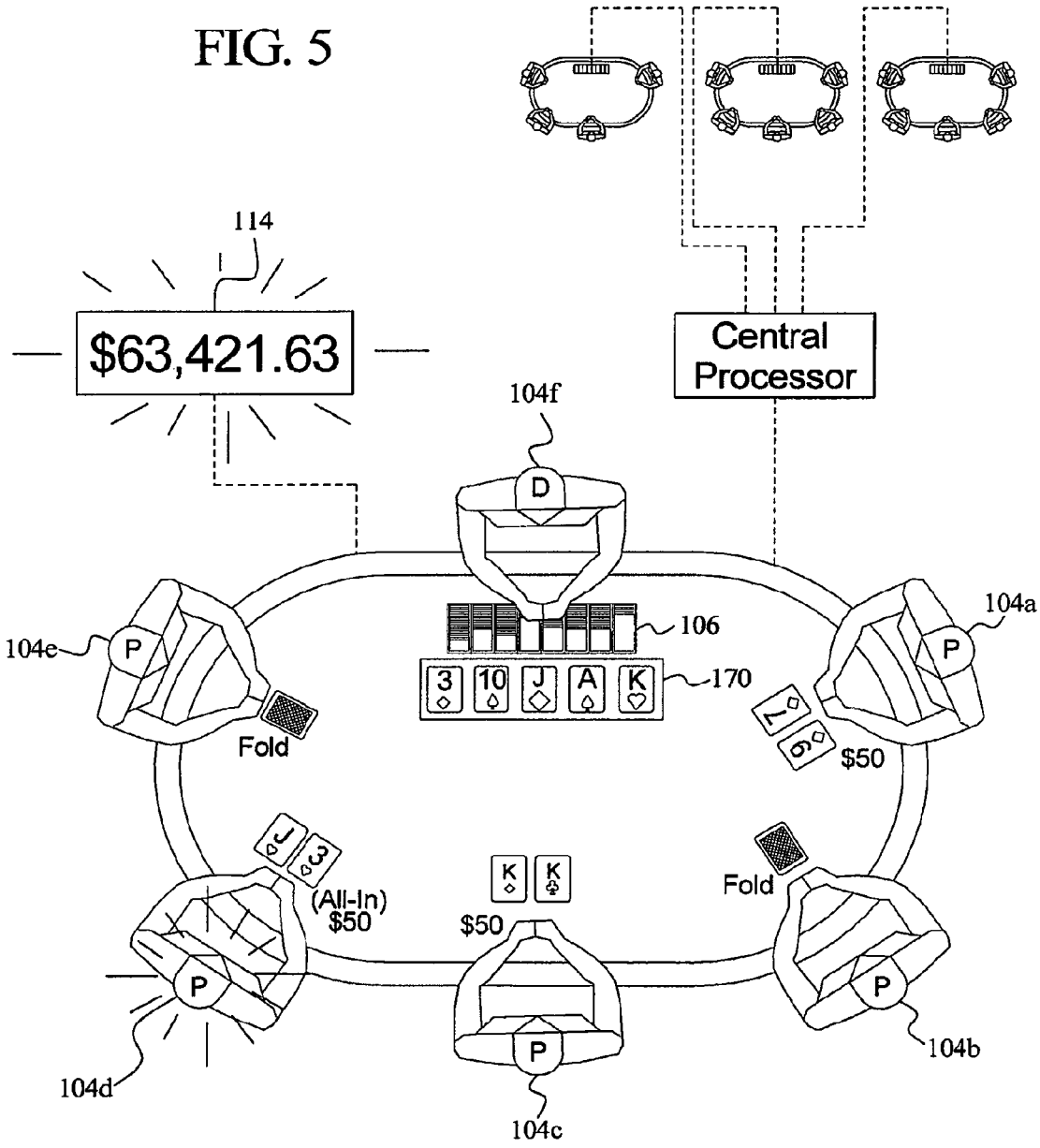
FIG. 5 is a top view of one embodiment of the gaming system of the present disclosure including a progressive jackpot feature.

In the example illustrated in FIG. 5, the card game is the poker variation Texas Hold'em. As discussed above with regard to Texas Hold'em, the player's final hand is the best five cards selected from two hole cards and five community cards 170. The central processor randomly selected the player at the fourth player position 104*d*. This example illustrates the end of a round of play where the player's hand at the first player position 104*a* is only Ace-High (i.e., A), the player at the second player position 104*b* has folded, the player's hand at the third player position 104*c* is Three-of-a-Kind (i.e., K.diamond-solid.KK); the player's hand at the fourth player position 104*d* is Two-Pair (i.e., J J.diamond-solid.3.diamond-solid.3), and the player at the fifth player position 104*e* has folded. Therefore, the player at position 104*c* wins the pot by having the highest ranking hand of Three-of-a-Kind. However, because the player in the fourth player position 104*d* was randomly selected by the processor, was registered to play at the beginning of the hour, wagered all of their chips, and lost the hand to the player in the third player position 104*c*, the gaming system provides the fourth player with at least a portion of the progressive jackpot award.

In one embodiment, the gaming system informs the player that they are eligible to win the progressive jackpot award prior to the player deciding to wager all of their chips. In another embodiment, the player would be informed that they are eligible after they have wagered all of their chips. In another embodiment the player would be notified of winning the progressive jackpot award after they have wagered and lost the hand. In another embodiment, the progressive jackpot is funded by a portion of each rake from one or more gaming tables.

Therefore, winning the progressive jackpot award would more than compensate a player after they have wagered and lost all of their chips. Players may also be encouraged to wager all of their chips in the hope that they may qualify for the larger progressive jackpot award. Players that may not normally wager all of their chips with a particular hand may be more inclined to do so if they believe that they may be eligible for a potentially large jackpot.

Four of a Kind and Straight Flush Progressive Jackpot

In one embodiment, a progressive jackpot is applied to poker game variations that include one or more community cards, such as Texas Hold'em. Although examples are provided with reference to the poker variation of Texas Hold'em, it should be appreciated that the progressive jackpot may be applied to any suitable poker variation, as described above. The progressive jackpot is awarded when the player achieves a predetermined combination of cards.

In one embodiment, the predetermined combination of cards is a natural Four-of-a-Kind. A natural Four-of-a-Kind requires that the player is dealt a pair for their hole cards and then the remaining pair to form the Four-of-a-Kind is dealt during the flop, the turn, or the river. Therefore, two of the four cards are the player's hole cards and the other two cards are selected from the community cards.

In another embodiment, the predetermined combination of cards is a natural Straight Flush. A natural Straight Flush requires that the player is dealt two suited connectors for their hole cards. According to one definition, suited connectors are two cards of the same suit that are consecutive in rank (e.g., 2 3 or Q K). Under this definition, the player receives a natural Straight Flush only when the hole cards are consecutive and of the same suit. According to a second definition, suited connectors are any two cards of the same suit which, together with three additional cards, can potentially form a straight. Under this second definition, some examples of suited connectors include: A 3; Q 9; and 7.diamond-solid.9.diamond-solid. Hands such as 2 4 are also commonly known as one gap hands because exactly one card (i.e., the 3) is required to connect the 2 and the 4 to form the Straight Flush. Similarly, two gap and three gap hands can potentially form a straight with three additional cards. The remaining three cards to form the Straight Flush must be dealt on the flop, the turn, or the river. Therefore, two of the five cards to form the Straight Flush are the player's hole cards and the other three cards are community cards.

Figure 6:
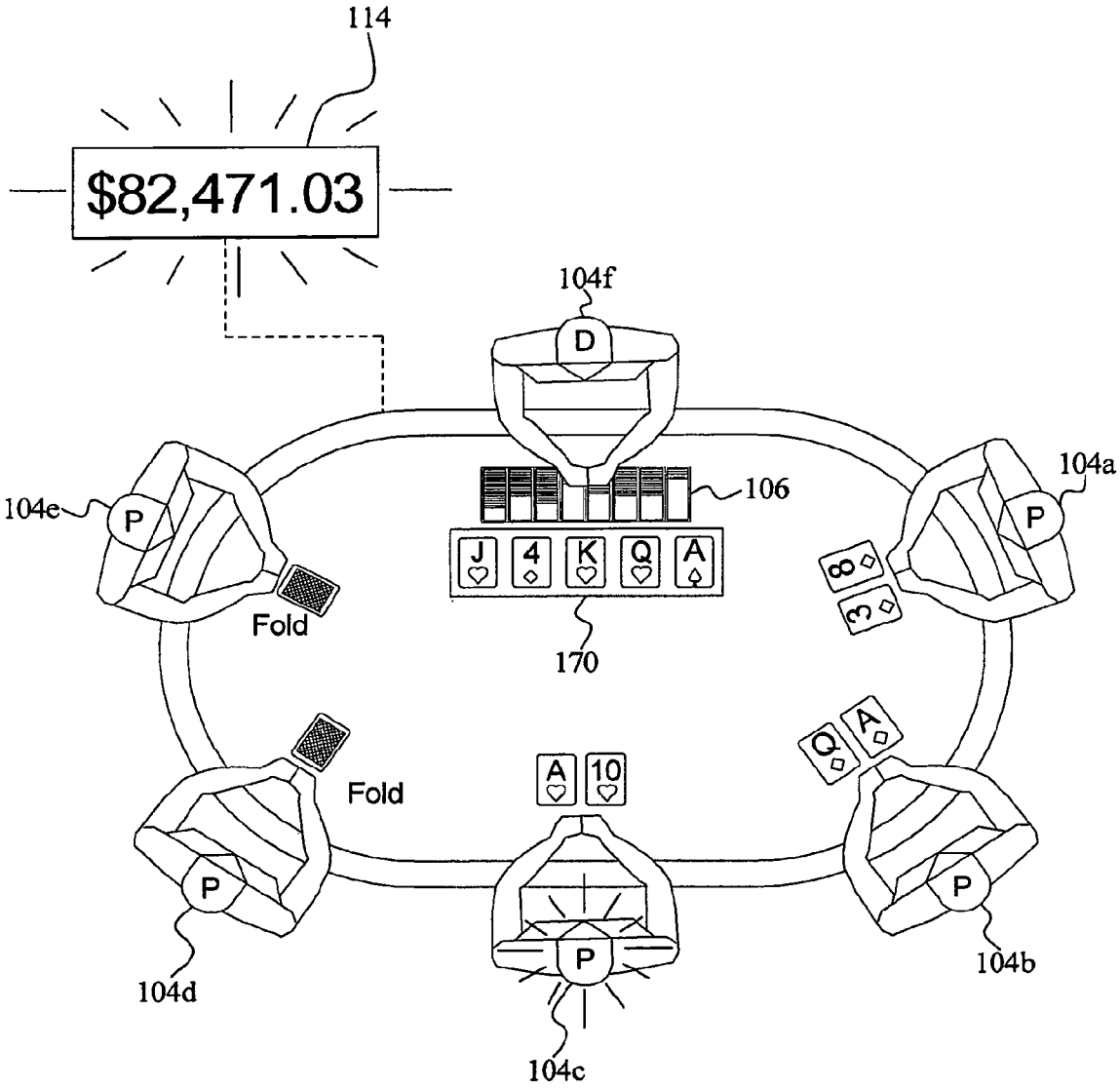
FIG. 6 is a top view of one embodiment of the gaming system of the present disclosure including a progressive jackpot feature.
Figure 7:
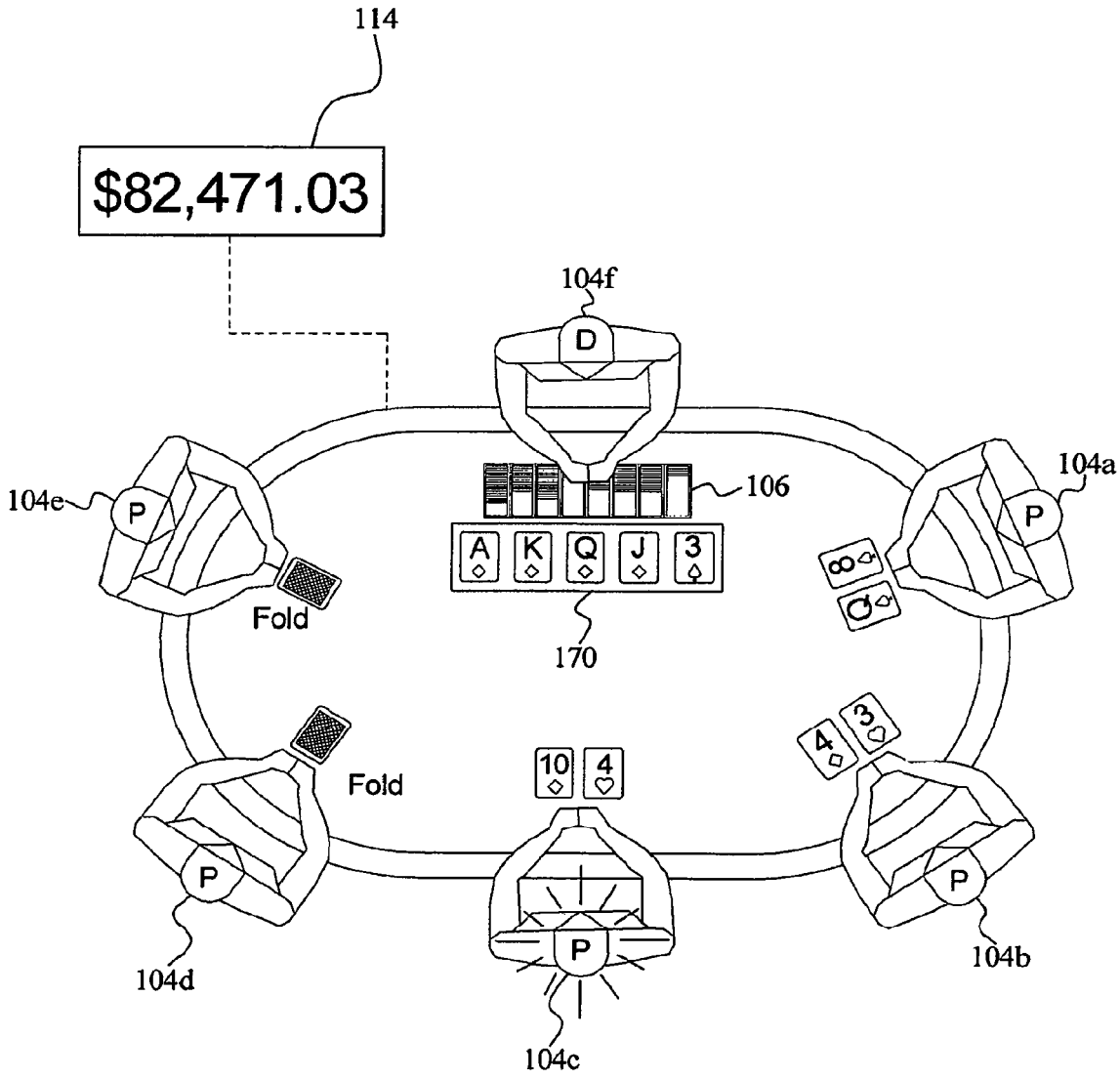
FIG. 7 is a top view of one embodiment of the gaming system of the present disclosure including a progressive jackpot feature.

In the examples illustrated in FIGS. 6 and 7, both players seated at player position 104*c* have achieved a Royal Straight Flush. In FIG. 6, both of the player's hole cards (i.e., A 10) formed part of the Straight Flush (i.e., A K Q J 10). Therefore, this player achieved a natural straight flush and is provided at least a portion of the progressive jackpot award 114. However, in FIG. 7, only one of the player's hole cards (i.e., 10.diamond-solid.) formed part of the Straight Flush (i.e., A.diamond-solid.K.diamond-solid.Q.diamond-solid.J.diamond-solid.10.diamond-solid.). Therefore, this player did not achieve a natural straight flush because only one the hole cards was used. Accordingly, although this player will undoubtedly win the pot, the player does not win the progressive jackpot award.

Best Hand Progressive Jackpot.

In one embodiment, the gaming system includes a gaming table adapted for a poker game and includes a progressive jackpot award provided to a player who achieves the highest ranking hand during a specific time period. In one example, the tracking system tracks every hand dealt for all registered players during a specific period of time, such as a twenty-four hour period. After the expiration of the time period, the gaming system awards at least a portion of the progressive jackpot to the player who has achieved the highest ranking hand during the previous time period.

In an example where the card game is Five Card Draw, the best hand may be the first five cards dealt to the player or it may be the player's final hand after drawing new cards. In another example, the poker game is a poker variation involving hole cards and community cards, such as Texas Hold'em. In this example, the best hand must include both of the player's hole cards. In other embodiments, the best hand progressive jackpot may be applied to other table games including, for example, a Blackjack game. In an example of a Blackjack game, the progressive jackpot may be awarded to the player that has achieved the best five card poker hand formed from the cards dealt in a play of the underlying Blackjack game. In this example, the five card poker hand is preferably formed from an underlying Blackjack hand including at least five cards.

In one embodiment, the best hand progressive jackpot is only awarded to a player only if they are registered at the time the progressive jackpot is awarded. Therefore, a player who either knows or believes that they have the best hand would be motivated to continue playing until the expiration of the time period. Otherwise, the player may end up forfeiting the award to a different player. This possibility of forfeiture also motivates players who may have the second or third highest hands to continue to play. The gaming establishment may further include a linked display device that displays the current highest ranking hand. Therefore, all players would know what they would need to beat in order to win the progressive jackpot.

In one embodiment, the progressive jackpot is funded at least partially by a portion of the rake.

Play to Win Progressive Jackpot

In one embodiment, the progressive jackpot is randomly awarded to a player who placed at least one wager during a previous qualifying time period and who is currently registered at a gaming table. In this embodiment, the gaming system includes a tracking system as described above, and the tracking system provides wagering information to the processor, such that a wagering history can be made for each player. In one example, the gaming system randomly selects a currently registered player and then determines from that player's wagering history whether or not the player had placed at least one wager during the specified time period. If the player had placed at least one wager, the player receives at least a portion of the jackpot award. If the randomly selected player did not place a wager, the gaming system randomly selects another player. Therefore, this type of progressive jackpot rewards the frequent player and encourages people to play more often. Also, players do not need to achieve a high ranking hand in order to qualify to win the jackpot award.

In one embodiment, the gaming establishment may provide the jackpot award during times when activity in the gaming establishment is slow. This strategy would encourage more players to play during off-peak periods. In another embodiment, the qualifying time period may be during these off-peak periods. In one embodiment, the progressive jackpot is at least partially funded from a portion of the rake.

Game Play Management

In one embodiment, the gaming table computer interface (as shown in FIG. 3) enables the dealer to set the wagering structure for a particular gaming table. The computer interface may include a touch screen input, as described above. For example, in a Blackjack game, the dealer can input using the touch screen the minimum and maximum bet. In a poker game, the dealer can input variation of poker being played and the amount of the ante or the blinds, depending on the variation of poker being played. In one embodiment, the system enables the dealer to enter information regarding the rake percentage. Alternatively, the game parameters can be established by the casino's central computer and downloaded to the computer interface to be displayed to the dealer. Therefore, the dealer would be informed on any changes in the betting structure or house rake percentage.

In one embodiment, the gaming system includes a gaming table configured for a live poker game, where the poker game is played with a fixed limit betting structure (i.e., fixed limit poker). With this type of betting structure, a player simply chooses whether or not to bet, and the amount of the bet is fixed by the house rules. In this embodiment, the gaming system includes a computer interface with an input that enables the dealer to enter information regarding whether a player has folded, bet, or raised. Therefore, because the wagering amounts are fixed by the house rules, the dealer can quickly enter whether the player has bet or raised and the processor is able to update the size of the pot by inferring the amount of the wager from the wagering rules. In another embodiment, the computer interface includes three inputs, one for folding, betting and raising, respectively. In another embodiment, the computer interface includes an additional input that enables the dealer to correct a previous input error. In one embodiment, the gaming system further includes at least one player identification card reader. In this embodiment, the dealer is able to associate a particular player with a particular player position. Therefore, when the dealer enters wagering information, the gaming system is able to credit the player with these amounts. Accordingly, the gaming establishment is better able to identify frequent players that are deserving of special compensation rewards. This system can be employed in any of the embodiments disclosed herein.

In another embodiment, the gaming system is configurable through a central controller connected through a network, as seen in FIG. 2. In this embodiment, each gaming table includes a computer interface, as described above. The computer interface enables the gaming system to communicate with the central controller and further includes a player identification input device for player tracking. The central controller is operable to issue commands to any of the gaming system regarding required changes in wagering structure, type of game, rules for a particular game, and any changes in the rules regarding the progressive jackpot award. In response to commands from the central controller, the gaming system causes the information to be displayed to the dealer on the computer interface, enabling the dealer to implement the changes.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A gaming system, said gaming system comprising:

at least one processor; and a tracking system for a table for a live card game, said live card game employing at least one deck of physical playing cards, said table including a support structure, a playing surface, a plurality of player positions for a plurality of players, a dealer position, and at least one wagering area, said tracking system including:

(i) at least one player identification input device, and (ii) a chip identifier configured, for each play of the live card game, for each of the plurality of player positions, to identify each chip wagered by the player at said player position in said play of the live card game and communicate information regarding an amount of each chip wagered by the player at said player position to the at least one processor to enable the at least one processor to determine whether or not to provide at least one award to the player at said player position, and wherein the at least one processor is programmed to:

(i) for each of the plurality of player positions:

(a) receive, from the chip identifier, the information regarding the amounts wagered by the player at said player position, and (b) update a player profile associated with any player identification input using the at least one player identification input device by the player at said player position with game play information, said game play information including the information regarding the amounts wagered by the player at said player position, said player profile storing said game play information for determining whether or not to provide at least one award to the player at said player position, and (ii) at an end of a designated play of the live card game:

(a) randomly select one of the players at the plurality of player positions, (b) after randomly selecting one of the players at the plurality of player positions, determine whether or not to provide a progressive jackpot award to said randomly selected one of the players based at least in part on the information regarding the amounts wagered by said randomly selected one of the players received from the chip identifier and stored in the player profile associated with said randomly selected one of the players, (c) if the determination is to provide the progressive jackpot award to said randomly selected one of the players, provide the progressive jackpot award to said randomly selected one of the players, and (d) if the determination is not to provide the progressive jackpot award to said randomly selected one of the players:

(i) not provide the progressive jackpot award to said randomly selected one of the players, and (ii) randomly select another one of the players at said plurality of player positions and repeat (ii)(b) to (ii)(d) until the determination is to provide the progressive award to the randomly selected one of the players.

2. The gaming system of claim 1, wherein the at least one processor is programmed to calculate a value of a house rake based at least in part on a sum of the identified wager amounts communicated by the chip identifier.

3. The gaming system of claim 2, wherein the progressive jackpot award is funded at least partially by a portion of the house rake, and wherein the house rake is based on a value of a pot.

4. The gaming system of claim 1, wherein the at least one processor is programmed to determine to provide the progressive jackpot award to the randomly selected one of the players if said randomly selected one of the players has placed at least one wager during a determined period of time.

5. The gaming system of claim 4, wherein the determined period of time is selected from the group consisting of: a previous twenty-four hours; a previous calendar day; a previous hour; and a previous calendar week.

6. The gaming system of claim 1, wherein the live card game is a no-limit poker game, wherein each of the plurality of players have a number of wagering chips, and wherein the at least one processor is programmed to provide the progressive jackpot award to the randomly selected one of the players if said randomly selected one of the players has been registered at the table for a determined amount of time and if, on a designated play of the live card game, said randomly selected one of the players wagers all of said player's remaining wagering chips and loses said designated play of the live card game.

7. The gaming system of claim 6, wherein the determined period of time is selected from the group consisting of: a previous hour; a previous twenty-four hours; a previous calendar day; and a previous calendar week.

8. The gaming system of claim 6, wherein the progressive jackpot award is funded at least in part by a portion of a house rake for each play of the live card game at the table.

9. A method of operating a gaming system, said method comprising:

(a) for each play of a live card game employing at least one deck of physical cards at a table, said table including a support structure, a playing surface, a plurality of player positions for a plurality of players, a dealer position, and at least one wagering area, causing a chip identifier, for each of the plurality of player positions, to:
  (i) identify each chip wagered by the player at said player position, and
  (ii) communicate information regarding an amount of each chip wagered by the player at said player position to at least one processor to enable the at least one processor to determine whether or not to provide at least one award to the player at said player position; and (b) causing the at least one processor to:
  (i) for each of the plurality of player positions:
    (A) receive, from the chip identifier, the information regarding the amounts wagered by the player at said player position, and
    (B) update a player profile associated with any player identification input by the player at said player position using a player identification input device with game play information, said game play information including the information regarding the amounts wagered by the player at said player position, said player profile storing said game play information for determining whether or not to provide at least one award to the player at said player position, and
  (ii) at an end of a designated play of the live card game,
    (A) randomly select one of the players at the plurality of player positions,
    (B) after randomly selecting one of the players at the plurality of player positions, determine whether or not to provide a progressive jackpot award to said randomly selected one of the players based at least in part on the information regarding the amounts wagered by said randomly selected one of the players received from the chip identifier and stored in the player profile associated with said randomly selected one of the players,
    (C) if the determination is to provide the progressive jackpot award to said randomly selected one of the players, provide the progressive jackpot award to said randomly selected one of the players, and
    (D) if the determination is not to provide the progressive jackpot award to said randomly selected one of the players:
      (i) not provide the progressive jackpot award to said randomly selected one of the players, and
      (ii) randomly select another one of the players at said plurality of player positions and repeat (b)(ii)(B) to (b)(ii)(D) until the determination is to provide the progressive award to the randomly selected one of the players.

10. The method of claim 9, which includes calculating a value of a house rake based at least in part on a sum of the wager amounts identified by the chip identifier.

11. The method of claim 10, which includes funding the progressive jackpot award at least in part by a portion of the house rake, wherein the house rake is based on a value of a pot.

12. The method of claim 9, which includes causing said at least one processor to determine to provide the progressive jackpot award to the randomly selected one of the players if said randomly selected one of the players placed at least one wager during a determined period of time.

13. The method of claim 12, wherein the determined period of time is selected from the group consisting of: a previous twenty-four hours; a previous calendar day; a previous hour; and a previous calendar week.

14. The method of claim 9, wherein the live card game is a no-limit poker game, wherein each of the plurality of players have a number of wagering chips, and which includes providing the progressive jackpot award to the randomly selected one of the players, if said randomly selected one of the players has been registered at the table for a determined amount of time and if, on a determined play of the live card game, said randomly selected one of the players wagers all of said player's remaining chips and loses the hand.

15. The method of claim 14, wherein the determined period of time is selected from the group consisting of: a previous hour; a previous twenty-four hours; a previous calendar day; and a previous calendar week.

16. The method of claim 14, which includes funding the progressive jackpot award at least in part by a portion of a house rake for each play of the live card game at the table.

* * * * *

UNITED STATES PATENT AND TRADEMARK OFFICE

CERTIFICATE OF CORRECTION

PATENT NO. : 8,118,669 B2
APPLICATION NO. : 12/352962
DATED : February 21, 2012
INVENTOR(S) : Rader et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 36 days.

Signed and Sealed this
Twenty-ninth Day of May, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,118,669 B2
APPLICATION NO. : 12/352962
DATED : February 21, 2012
INVENTOR(S) : Richard M. Rader et al.

It is certified that error appears in the above-identified patent and that said Letters Patent is hereby corrected as shown below:

IN THE CLAIMS

In Column 14, Claim 6, Line 50, replace “have” with --has--.
In Column 14, Claim 7, Line 60, replace “period” with --amount--.
In Column 16, Claim 14, Line 29, replace “have” with --has--.
In Column 16, Claim 14, Line 31, delete the “,” following “players.”.
In Column 16, Claim 15, Line 36, replace “period” with --amount--.

Signed and Sealed this
Fourteenth Day of August, 2012

David J. Kappos

David J. Kappos
*Director of the United States Patent and Trademark Office*